US006142000A

United States Patent [19]

Rohde

[11] Patent Number: 6,142,000

[45] Date of Patent: Nov. 7, 2000

[54] METHOD OF OPERATING A ROLLING MILL FOR HOT-ROLLING AND COLD-ROLLING OF FLAT PRODUCTS

[75] Inventor: Wolfgang Rohde, Dormagen, Germany

[73] Assignee: SMS Schloemann-Siemag Aktiengesellschaft, Düsseldorf, Germany

[21] Appl. No.: 09/281,485

[22] Filed: Mar. 30, 1999

Related U.S. Application Data

[63] Continuation of application No. 09/069,298, Apr. 29, 1998, abandoned.

[30] Foreign Application Priority Data

May 2, 1997 [DE] Germany ..... 197 18 529

[51] Int. Cl.[7] ..... B21B 37/58

[52] U.S. Cl. ..... 72/10.4; 72/14.4; 72/365.2

[58] Field of Search ..... 72/10.1, 10.4, 72/365.2, 10.6, 10.7, 13.1, 13.2, 13.4, 14.4, 14.5, 237, 238, 241.6, 241.8, 247, 248

[56] References Cited

U.S. PATENT DOCUMENTS

| | | | |
|---|---|---|---|
| 5,279,139 | 1/1994 | Sturn | 72/237 |
| 5,448,901 | 9/1995 | Yu et al. | 72/247 |
| 5,775,154 | 7/1998 | Haberkamm | 72/247 |

FOREIGN PATENT DOCUMENTS

| | | | |
|---|---|---|---|
| 0763391 | 3/1997 | European Pat. Off. . | |
| 3000187 | 12/1980 | Germany . | |
| 59-24509 | 2/1984 | Japan | 72/10.1 |
| 5-169120 | 7/1993 | Japan | 72/10.1 |
| 6-154832 | 6/1994 | Japan | 72/10.1 |

OTHER PUBLICATIONS

Patent Abstracts of Japan, vol. 017, No. 520 (M–1482), Sep. 20, 1993 & JP 05 138219 A (Kawasaki Steel Corp), Jun. 1, 1993.

Patent Abstracts of Japan, vol. 011, No. 006 (M–551), Jan. 8, 1987 & JP 61 182816 A (Ishikawajima Harima Heavy Ind Co Ltd), Aug. 15, 1986.

Patent Abstracts of Japan, vol. 008, No. 116 (M–299), May 30, 1984 & JP 59 024509 A (Hitachi Seisakusho KK), Feb. 8, 1984.

*Primary Examiner*—Ed Tolan
*Attorney, Agent, or Firm*—Friedrich Kueffner

[57] ABSTRACT

A method of operating a rolling mill for hot-rolling and cold-rolling of flat products in one or more roll stands each having two or more rolls, wherein the roll gaps are regulated so as to correct the differential force between the drive side and the operator side of the roll stands, while compensating the adjustment value-controlled regulation of the roll gaps which corrects the bending and balancing forces. Prior to further processing of the flat products, the regulation is supplied with an additional correction adjustment value formed from the horizontal forces measured in all individual rolls.

1 Claim, No Drawings

METHOD OF OPERATING A ROLLING MILL FOR HOT-ROLLING AND COLD-ROLLING OF FLAT PRODUCTS

This application is a continuation of Ser. No. 09/069,298 filed Apr. 29, 1998, now abandoned.

BACKGROUND OF THE INVENTION

1. Field of the Invention

The present invention relates to a method of operating a rolling mill for hot-rolling and cold-rolling of flat products in one or more roll stands each having two or more rolls, wherein the roll gaps are regulated so as to correct the differential force between the drive side and the operator side of the roll stands, while compensating the adjustment value-controlled regulation of the roll gaps which corrects the bending and balancing forces.

2. Description of the Related Art

When rolling flat products, such as hot-rolled wide strip or cold-rolled strip, on tandem rolling trains or also on reversing trains, the essential requirement which determines the quality is that the strip planarity is maintained over the entire rolled strip length. In order to meet this requirement, it is necessary that all of the stands participating in the rolling process maintain parallel roll gaps which determine the geometric shape of the cross-section of the strip.

It is difficult to meet the above-described requirement because of the differential forces which occur between the individual forces on the drive side and the operator side of the rolling train. These differential forces are the result of eccentric movements during the strip travel; they produce an increase of the extension on the housing side with the higher rolling force and lead to asymmetrical strip travel and, thus, to planarity errors.

In order to avoid these disadvantages, it has already been proposed to carry out a regulation in which the occurring differential forces are continuously measured and are converted through the so-called cross modulus into extension values on the two housing sides. These extension values can be compensated by appropriate nominal position values for the two adjustment systems on the drive side and the operator side of the roll stands. Consequently, the shape of the roll gap remains uninfluenced by the eccentric strip travel.

However, this type of regulation is harmfully influenced by the unequal forces during bending of the work rolls and balancing of the back-up rolls and work rolls on the drive side and the operator side of the roll stands; the regulation is harmfully influenced by the fact that the sizes of the lever arms of these forces are uneven as a result of the displacement of the rolls and as a result of reaction forces which result from the horizontal forces at the work rolls, the back-up rolls and possibility the intermediate rolls.

Therefore, it has already been proposed to measure the effects of the different forces from balancing and bending systems and the different lever arms and to utilize the measurement results for correcting the rolling forces at the drive side and the operator side. However, not taken into consideration in this method were the above-mentioned horizontal forces which may lead, depending on their direction, to significant differential forces in the adjustment systems.

It is known from DE 30 00 187 C2 to compensate the rolling forces which can be measured on the drive and the operator side and which are produced by the roll displacement. This displacement frequently takes place at a relatively high speed and the resulting horizontal forces reach values which are close to the frictional forces occurring between the rolls. The horizontal forces are determined by assuming a constant coefficient of friction. However, it is always a requirement that the rolls are displaced relative to each other.

The present invention is based on the finding that the horizontal forces which occur even without any roll displacement require a compensation. These inner horizontal forces are due to a type of screw effect of the rolls which roll on each other without any axial relative movement. This screw-type movement is triggered by the crossing of the rolls within the housing windows of the roll stands, wherein, for example, in stands of hot-rolled wide strip finishing trains, these forces reach an order of magnitude of 500 kN (about 50 t), with the attendant disadvantageous effect on the parallelism of the roll gap which is known to rolling mill experts. In contrast to the methods described above, the conversion of the compensation values for the rolling force measurement in the housing crossbeams makes it necessary to measure the axial forces in all rolls of the roll stand.

SUMMARY OF THE INVENTION

Therefore, it is the primary object of the present invention to provide a method of the above-described type which avoids the disadvantages described above, particularly to eliminate the effect of the occurring horizontal forces on the housing posts of the roll stands and the resulting differential rolling force in the adjustment systems, and to ensure that even a change of the magnitude and direction of the axial forces during the operation does not result in a change of the differential rolling force between the drive side and the operator side.

In accordance with the present invention, prior to further processing of the flat products, the regulation is supplied with an additional correction adjustment value formed from the horizontal forces measured in all individual rolls.

The various features of novelty which characterize the invention are pointed out with particularity in the claims annexed to and forming a part of the disclosure. For a better understanding of the invention, its operating advantages, specific objects attained by its use, reference should be had to the following descriptive matter in which there are described preferred embodiments of the invention.

DETAILED DESCRIPTION OF THE INVENTION

The present invention makes it possible, by utilizing the corrected differential rolling force and using the cross modulus for a pivoting regulation, to maintain the roll gap contour over the strip width independently of the strip position and the force distribution and, in addition, the present invention makes it possible after a roll change for effecting calibration to regulate the compensated differential rolling force toward zero after the rolls have been placed one top of the other.

In accordance with another feature of the present invention, the measurement of the forces in the individual work rolls can be effected by force pickups which are mounted in the supports of the rolls, and the measurement of the axial forces can be effected by measuring the hydraulic pressures in those rolls which are pulled hydraulically, possibly by actual force value pickups arranged in the bearing housings of the roll bearings.

By measuring the axial forces of all rolls of each roll stand, the individual force pairs are determined in dependence on the actual roll diameters. The occurring differential roll force is computed on-line from the sums of the force pairs. By interlinking with the cross modulus, compensation values for the adjustment systems are determined and utilized for compensating the measured roll forces on the drive side and the operator side.

Together with the already known compensation of bending forces and balancing forces, the measures according to the present invention ensure that the differential rolling force from the drive side to the operator side is purified of all force components whose cause is not to be found in the roll gap itself.

While specific embodiments of the invention have been described in detail to illustrate the inventive principles, it will be understood that the invention may be embodied otherwise without departing from such principles.

What is claimed is:

1. A method of carrying out an adjustment value-controlled regulation of roll gaps defined by rolls of roll stands of a rolling mill for hot-rolling and cold-rolling of flat products, the method comprising measuring rolling forces at a drive side and an operator side of each roll stand and correcting an adjustment of the rolls in dependence on differential rolling forces between the drive side and the operator side, further comprising additionally measuring axial forces of the rolls produced in a direction of roll axes as a result of rolling, and utilizing the axial forces as additional correction values for the roll adjustments, wherein the axial forces of individual work rolls are measured by force pickups mounted in supports of the rolls, and wherein the axial forces of rolls which are hydraulically displaced are measured by measuring hydraulic pressures in the rolls.

* * * * *